US006412714B1

(12) United States Patent
Witsken et al.

(10) Patent No.: US 6,412,714 B1
(45) Date of Patent: Jul. 2, 2002

(54) APPARATUS FOR MIXING, GRINDING, DISPERSING OR EMULSIFYING

(76) Inventors: Anthony Witsken, 4415 School Section Rd., Cincinnati, OH (US) 45211; A. C. Knox, 525 Purcell Ave., Cincinnati, OH (US) 45205

( * ) Notice: Subject to any disclaimer, the term of this patent is extended or adjusted under 35 U.S.C. 154(b) by 0 days.

(21) Appl. No.: 09/374,661

(22) Filed: Aug. 16, 1999

(51) Int. Cl.[7] ..... B02C 23/36

(52) U.S. Cl. ..... 241/21; 241/46.11; 241/86.1; 241/89.3; 366/264; 366/305

(58) Field of Search ..... 241/2, 21, 46.017, 241/46.08, 46.11, 86.1, 89.3, 91, 95, DIG. 30; 366/264, 305

(56) References Cited

U.S. PATENT DOCUMENTS

| | | | | |
|---|---|---|---|---|
| 2,619,330 A | | 11/1952 | Willems | |
| 2,985,389 A | | 5/1961 | Willems | |
| 3,869,091 A | * | 3/1975 | Enkegaard et al. | 241/DIG. 30 |
| 3,912,236 A | | 10/1975 | Zipperer et al. | |
| 3,982,700 A | * | 9/1976 | Love | 241/46.11 |
| 4,052,009 A | * | 10/1977 | Penque | 241/46.017 |
| 4,570,863 A | | 2/1986 | Knox, Jr. et al. | |
| 4,813,617 A | | 3/1989 | Knox, Jr. et al. | |
| 5,024,647 A | | 6/1991 | Jubin et al. | |
| 5,203,515 A | | 4/1993 | Stoerzbach | |

FOREIGN PATENT DOCUMENTS

| | | |
|---|---|---|
| CH | 604894 | 12/1977 |

* cited by examiner

*Primary Examiner*—Mark Rosenbaum
(74) *Attorney, Agent, or Firm*—Wood, Herron & Evans, L.L.P.

(57) ABSTRACT

An apparatus for mixing, grinding, dispersing or emulsifying including a rotatable drive, a rotor body connected for rotation with the drive and having at least one aperture for fluid flow through the rotor body and a flow divider plate structure extending within the rotor body for preventing conglomeration of particulates contained within the fluid in the rotor body. Preferably, a stator body is secured outside of the rotor body and each of the rotor and stator bodies include respective apertures for allowing fluid flow therethrough. The flow divider plate structure prevents the usual swirling action of liquid and solid particulates within the rotor body such that the mixture has a more desirable flow pattern and so that particulates do not conglomerate to form a mass that clogs the rotor body. Further aspects and embodiments of the invention provide advantageous seal structure and structure for increasing productivity.

15 Claims, 8 Drawing Sheets

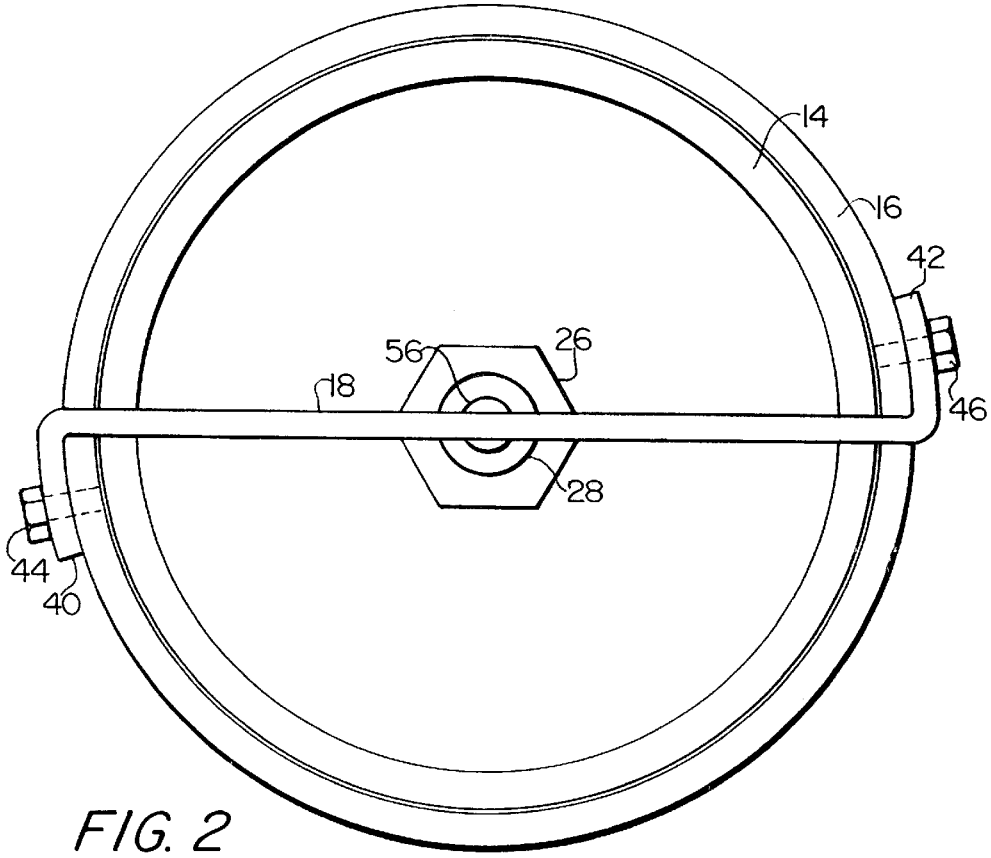
FIG. 2
FIG. 4
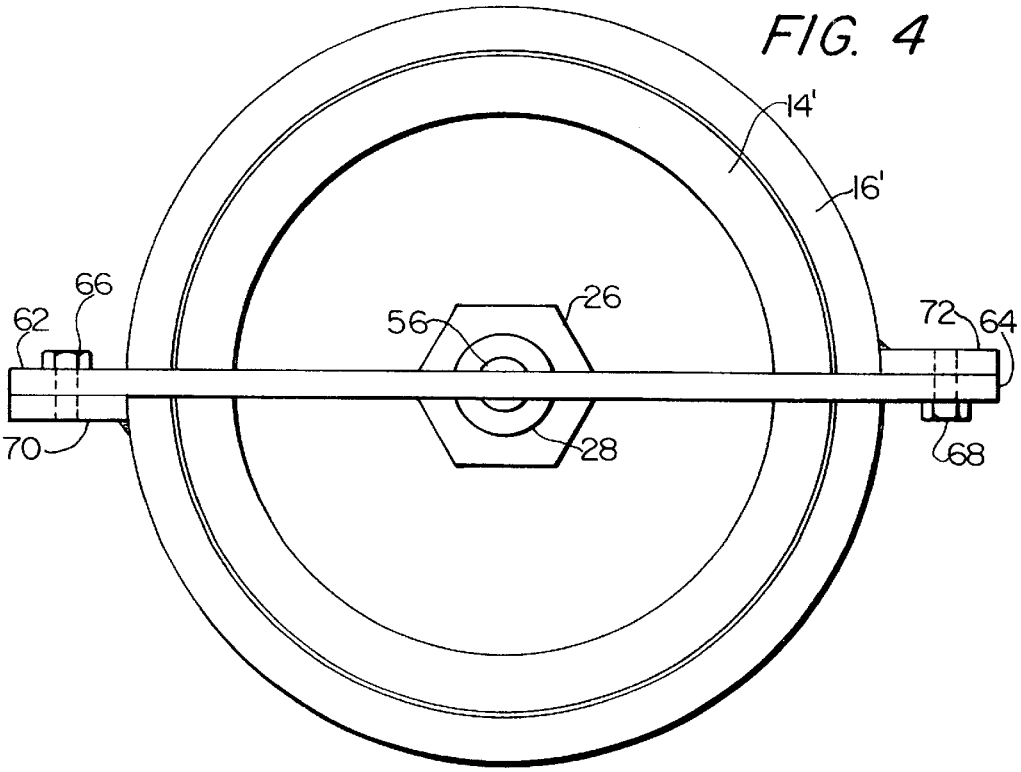

APPARATUS FOR MIXING, GRINDING, DISPERSING OR EMULSIFYING

FIELD OF THE INVENTION

The present invention generally relates to apparatus for mixing, grinding, dispersing and emulsifying liquid mixtures and liquids containing solid particles and, more specifically, to such a device having various improvements generally related to reducing conglomeration of particles, reducing wear and friction related heat problems and increasing productivity.

BACKGROUND OF THE INVENTION

Many devices employ rotors and stators for wet grinding, mixing, dispersing and emulsifying. In such devices the stator is stationary while the rotor rotates to centrifugally force the liquid to the periphery of the device. During this movement, solid and liquid components of the mixture may be mixed, dispersed, emulsified or ground and finally ejected from the device. Many different grinding or cutting elements of the rotor and stator may be used to reduce the size of solid or semi-solid particulates in the liquid.

One example of a grinding apparatus for reducing the size of solid particulates or particles contained in a liquid is disclosed in U.S. Pat. No. 4,813,617 (the '617 patent) entitled "Wet Grinding Machine," the disclosure of which is hereby fully incorporated by reference herein. This wet grinding machine uses a hollow cylindrical rotor with blades and slots in the wall of the rotor and adjacent rows of slots in the stator. Upper slots in the stator are larger than lower slots such that large particles are disintegrated by, shearing action between the upper stator slots and cooperating rotor slots while smaller particles may be disintegrated by the smaller sized slots in the stator. In most respects the rotor and stator of the '617 patent have commendable grinding ability, however, the two rows of slots require a longer or deeper rotor and stator. This increases the centrifugal effect and produces a higher vacuum lift of particles into the rotor. Thus, in the above apparatus and other similar apparatus, the rotor and stator may not be able to handle the increased volume of some types of solid particulates caused by the vacuum lifting action. These particulates may then conglomerate in the spiraling fluid and heat up due to friction between the particulates themselves and contact with the rotor and stator. Consequently, the particulates may conglomerate and form a solid or semisolid plug in the rotor. This may, in turn, effectively stop the flow of material through the apparatus and even cause the device to over heat or completely stop operating.

This is a particular problem with polymer particles, such as elastomers used to form adhesives, as these particles tend to soften and stick together at elevated-temperatures. While the liquid may simply travel through the voids between the particles of the conglomerating mass of solid particulates and exit through the slots in the rotor and stator, the solid particulates will gradually stop flowing through the slots in the rotor and stator due to the growing plug or mass of particles.

A device disclosed in U.S. Pat. No. 5,024,647, issued to The United States of America as represented by the United States Department of Energy, uses vanes below a rotor to inhibit formation of vortices within the rotor. However, the device itself is suitable for processing liquids and does not address the conglomeration problem of apparatus for processing liquids and particulates.

Many products processed in rotor/stator devices are slurry solutions that provide good lubrication to bushing or bushings of the device during use. However, in some applications, the product is not an effective lubricant and may even be abrasive. Some products form small spheres and some coagulate and crust as a result of friction induced heat. In the past, devices have employed hardened metal bushings, such as those formed by stellite processes, to overcome the problems of wear and abrasion. This solution, however, is quite expensive and therefore undesirable from a commercial standpoint. Other systems use lubricants to wash abrasives away from bushings, however, it is not often desirable to add a significant amount of lubricating liquid to the product in this manner.

To overcome these and similar problems in this field, it would desirable to provide economically manufactured devices that prevent the conglomeration of particles in centrifugal devices not only to prevent these devices from being completely plugged, but also to prevent any significant fusion of solid particulates that would lead to decreased effectiveness of the device. It would also be desirable to provide grinding devices that work well in abrasive or otherwise harsh applications while maintaining an economic overall design.

SUMMARY OF THE INVENTION

It has therefore been one object of this invention to increase the productivity of devices relying on rotor and stators and used for purposes such as mixing, grinding, dispersing or emulsifying liquids containing solid particulates.

It has been another object of this invention to prevent plug formation in a rotor containing liquid and particulates, particularly polymer particulates softenable at elevated temperatures.

It has been yet another object of this invention to improve the circulation of both liquid and particulate solid matter within a rotor and between the rotor and stator of an apparatus for purposes such as grinding, mixing, dispersing or emulsifying.

To these ends, a preferred apparatus of this invention for mixing, grinding, dispersing, emulsifying and the like generally includes a rotatable drive and a rotor body operatively connected to the rotatable drive in any suitable manner. As is typical, the rotor body includes apertures for allowing fluid flow, such as in the form of a slurry solution, into and out of the body. In accordance with the preferred embodiment of the invention, flow divider plate structure extends within the rotor body for preventing conglomeration of particles contained within fluid in the rotor body.

Especially when the present invention is used in connection with grinding and emulsifying operations, a stator body may be attached to support structure of the apparatus and used together with the rotating rotor body to grind or emulsify solid particulates contained within liquid. In this aspect of the invention, the stator body is disposed at least partially within the rotor body and both the stator and rotor bodies include apertures for allowing fluid flow therethrough. These apertures and other blade structures of the apparatus may be designed in accordance with the '617 patent, for example, or be designed in any other suitable manner. In any case, their function is to shear or otherwise reduce the size of particulate matter preferably as it travels between the respective slots or apertures in the rotor and stator bodies.

Preferably, the flow divider plate structure is stationary relative to the rotor body and is fixed to generally lie along the central axis of the rotor body. For example, the flow divider plate structure may be a single plate that extend at least across substantially the entire diameter of the internal hollow space of the rotor body. The present invention, however, also contemplates flow divider plate structure comprised of two or more flow divider plates lying about the central axis but still extending within the rotor. For example, three or four plates could be extended along and radiate outward from the central axis while generally intersecting at the axis.

The rotor and stator bodies are generally cylindrically shaped in the preferred embodiment and the flow divider plate or plates extend preferably more than halfway into the rotor body from an open end thereof. More preferably, the plate structure extends to a location closely proximate or adjacent a closed end of the rotor body. The flow divider plate or plates are preferably rigidly affixed to support structure of the apparatus, such as the stationary stator body at an open end thereof. In this way, the flow divider plate structure may be maintained stationary relative to the rotor body.

In the preferred embodiment, the drive further includes a drive shaft directly affixed to the rotor body and the apparatus further includes a centering shaft connected between the drive shaft and the flow divider plate or plates. The end of the drive shaft includes a center bushing and the centering shaft is rigidly affixed to the flow divider plate and is disposed within the center bushing such that the drive shaft rotates with respect to the centering shaft. In conjunction with the rigid attachment of the flow divider plate structure to the support structure, such as the stator, the centering shaft therefore ensures that the flow divider plate maintains a stable, central position within the rotor body.

Especially in the cases in which the apparatus is used for grinding or emulsifying solid particulates contained in a liquid, apertures or blade structures in the rotor and stator bodies have shearing edges that cooperate to shear particles contained in liquid conveyed therebetween. Other means of shearing particles within the rotor and stator bodies may also be used, while still realizing benefits from the present invention.

In another aspect of this invention, a lubricant and coolant flushed seal is disposed generally between stationary support structure of the apparatus and the rotatable drive shaft of the apparatus. The seal includes a lip surrounding the rotatable shaft and a source of pressurized liquid is used to flush the lip of the seal with the liquid. The lip seal allows a slow, steady leakage of the pressurized liquid past the seal. This helps prevent abrasive materials from lodging between the drive shaft and the lip of the seal or traveling even farther up into additional mechanical seals or bearings associated with the apparatus. The liquid supplied to the seal may, for example, be water or any other suitable lubricant.

The invention further contemplates a method of grinding, mixing, dispersing or emulsifying a liquid containing solid particulates. Generally, the method comprises the steps of conveying a mixture of liquid and solid particles into a rotating, generally cylindrical rotor body and interrupting a resulting swirling flow of the mixture with a plate extending within the rotor body. This direct interruption of the swirling action prevents conglomeration of particles within the mixture. The flow divider plate structure further aids in this size reduction of the particles and acts as an internal stator.

Additional advantages and objects of the present invention will become more readily apparent to those of ordinary skill in the art upon review of the following detailed description of the preferred embodiments taken in conjunction with the accompanying drawings.

BRIEF DESCRIPTION OF THE DRAWINGS

FIG. 2 is an end view of the apparatus taken along line 2—2 of FIG. 1;

FIG. 4 is an end view taken along line 4—4 of FIG. 3;

DETAILED DESCRIPTION OF THE PREFERRED EMBODIMENT

Figure 1:
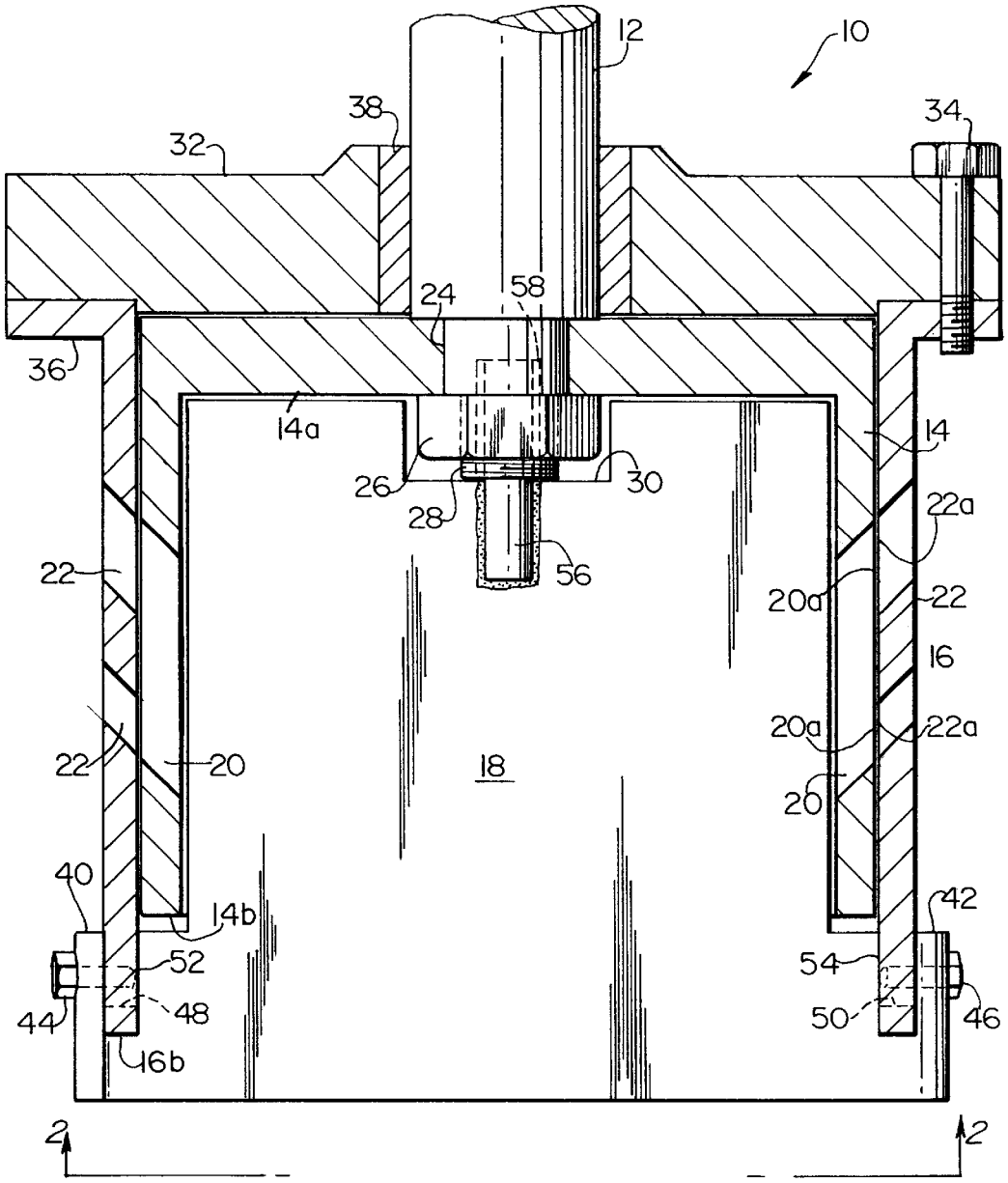
FIG. 1 is a side cross sectional view taken generally axially along an apparatus of the present invention.

Referring first to FIG. 1, an apparatus 10 constructed in accordance with one preferred embodiment of this invention is shown and generally includes a drive such as a rotatable drive shaft 12 driven by a motor (not shown) and a rotor body 14 affixed for rotation with drive shaft 12 as well as a stator body 16 receiving rotor body 14. Certain applications may not require stator body 16 or may require more than one rotor body 14 and/or stator body 16. As the particular constructions of the rotor and stator bodies 14, 16 are not specifically relevant to the invention, they have not been shown in the drawings in a particularly detailed manner. In accordance with the present invention, a flow divider plate 18 extends within rotor body 14 for directly disrupting or interrupting the normal swirling action that would otherwise occur in the liquid moving within rotor body 14. As previously mentioned, one flow divider plate 18 is preferred and shown, however, other flow divider plate structure including one or more intersecting plates may be utilized as well. Flow divider plate 18 is preferably held stationary relative to rotor body 14 in any suitable manner but preferably in the manners to be described.

As further shown in FIG. 1, rotor and stator bodies 14,16 include respective apertures 20, 22 for allowing fluid flow therebetween.

When apparatus 10 is used for grinding, for example, apertures 20, 22 may include respective shearing edges 20*a*, 22*a* for shearing and reducing the size of particulates contained in a liquid slurry solution as these particulates pass through apertures 20, 22. Apertures 22 in stator body 16 may lead to any appropriate outlet or apparatus 10 may simply be submerged in a tank of slurry containing liquid and particulate product such that the slurry is continuously circulated up into rotor body 14 and centrifugally forced through apertures 20, 22.

As also shown in FIG. 1, rotor body 14 is rigidly affixed to a necked down or reduced portion 24 of drive shaft 12 by a nut 26 tightened onto a threaded portion 28 of drive shaft 12. A cut-out 30 is formed in flow divider plate 18 for accommodating nut 26. As further shown in FIG. 1, flow divider plate 18 extends closely proximate to closed end 14*a* of rotor body 14. To realize the significant benefits from the present invention, flow divider plate 18 should extend at least part way into rotor body 14 and, more preferably, at least to the locations of apertures 20.

Support structure of apparatus 10, such as a support flange 32 holds stator body 16 stationary in the preferred embodiment. Certain applications, however, may require a second rotor body outside of rotor body 14. As shown in FIG. 1, support flange 32 is affixed to stator body 14 by bolts 34, although only one bolt 34 is shown. For this purpose, a flange portion 36 is provided on stator body 16. A cylindrical bushing 38 is disposed between drive shaft 12 and support flange 32. It will be appreciated that many support structures and drives may be used for supporting and rotating rotor body 14 and, as mentioned above, many substitutions may be made for stator body 16 depending on the application, including the complete elimination of stator body 16 when multiple rotor bodies are used instead.

Referring now to FIGS. 1 and 2, in the preferred embodiment the flow divider plate 18 is rigidly connected to stator body 16 at an open end 16*b* thereof. For this purpose, flow divider plate 18 includes opposite side members 40, 42 bent, as shown in FIG. 2, to lie adjacent an outside surface of stator body 16. Respective bolts 44, 46 are used to secure portions 40, 42 to stator body 16. A pair of slots 48, 50 are disposed in end 16*b* of stator body 16 and receive respective slots 52, 54 in flow divider plate 18 as a manner of locating and stabilizing flow divider plate with respect to stator body 16. An opposite end of flow divider plate 18 is preferably stabilized by a centering pin 56 securely affixed to flow divider plate 18, as by welding, and held within a bushing 58 press fit within drive shaft 12 along the axis of rotation thereof. Thus, the connections of flow divider plate 18 at each end thereof ensure that the flow divider plate is held in its preferred, stationary position along the axis of rotation of drive shaft 12 and rotor body 14 without allowing significant vibration or deflection due to forces that may be developed during operation of apparatus 10.

Figure 3:
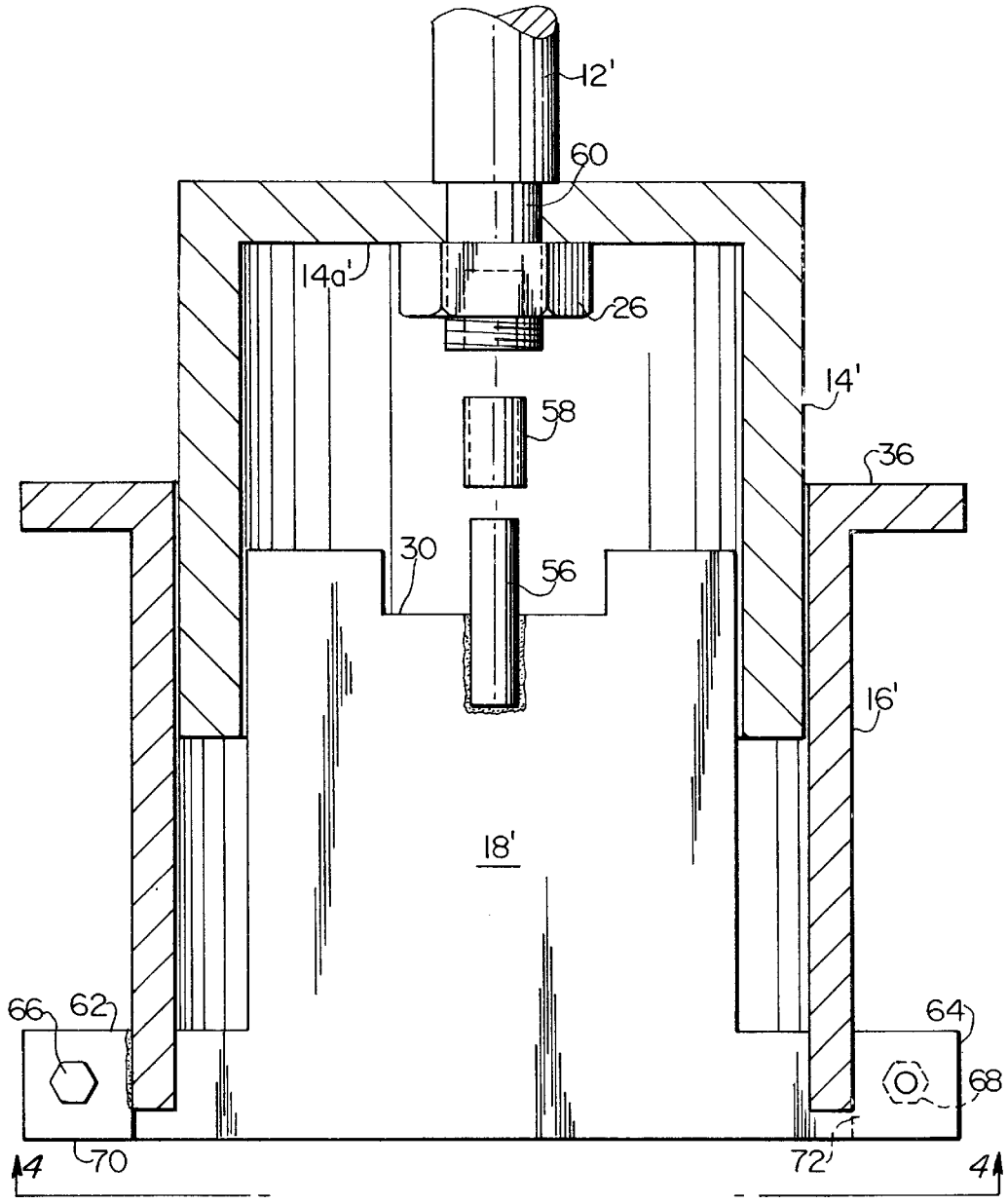
FIG. 3 is an exploded cross sectional view similar to FIG. 1 but showing alternative embodiments of the drive shaft and the connection between the flow divider plate and the stator body.

FIG. 3 illustrates an alternative embodiment of apparatus 10 and presents a partially exploded view to better illustrate the centering pin 56 and bushing 58. In this embodiment, like references numerals in FIGS. 1 and 3 represent like elements and need not be further described. Like reference numerals have prime (') marks to represent corresponding structure that has been slightly modified. Drive shaft 12' in FIG. 3 includes a necked down portion 60 which may be entirely threaded for receiving nut 26. The main difference between the embodiments of FIGS. 1 and 3 is in the connection of flow divider plate 18' to stator body 16'. Specifically, flow divider plate 18' includes side extensions 62, 64 which, instead of being bent to a location adjacent an outside surface of stator body 16', remain in the same plane as flow divider plate 18'. As shown best in FIG. 4, extensions 62, 64 are secured by screws or bolts 66, 68 to support members 70, 72 extending from stator body 16'. Support members 70, 72 may simply be welded to an outside surface of stator body 16'.

Figure 5:
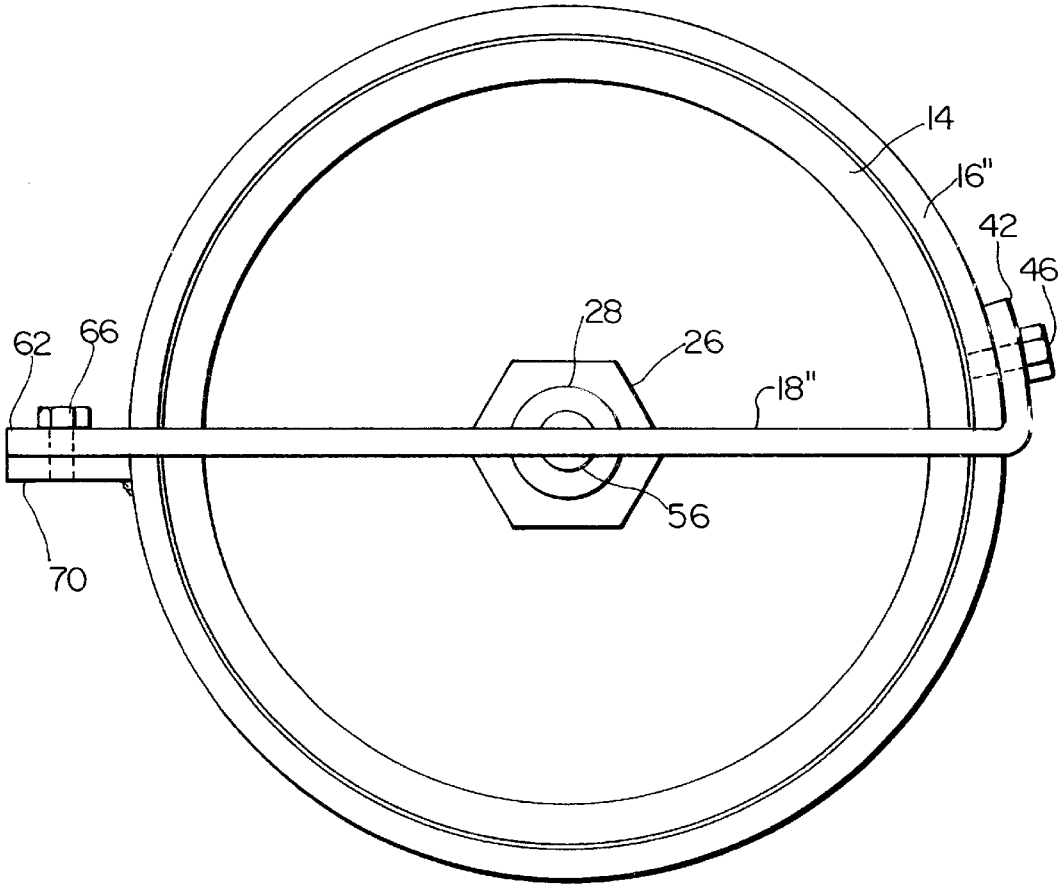
FIG. 5 is an end view similar to FIGS. 2 and 4 but showing a third alternative connection between the flow divider plate and the stator body.

FIG. 5 illustrates still another alternative connection between flow divider plate 18" and stator body 16". Here, like reference numerals with double prime marks (") represent corresponding structure with the first two embodiments that has slight modification. Like reference numerals refer to like structure between embodiments. In this embodiment, opposite side portions of flow divider plate 18" are affixed to stator body 16" using one of each of the connections shown respectively in FIGS. 2 and 4. Thus, flow divider plate 18" includes one side extension 62 and one bend portion 40 affixed to stator body 16" just as respectively shown in FIGS. 2 and 4.

Figure 6A:
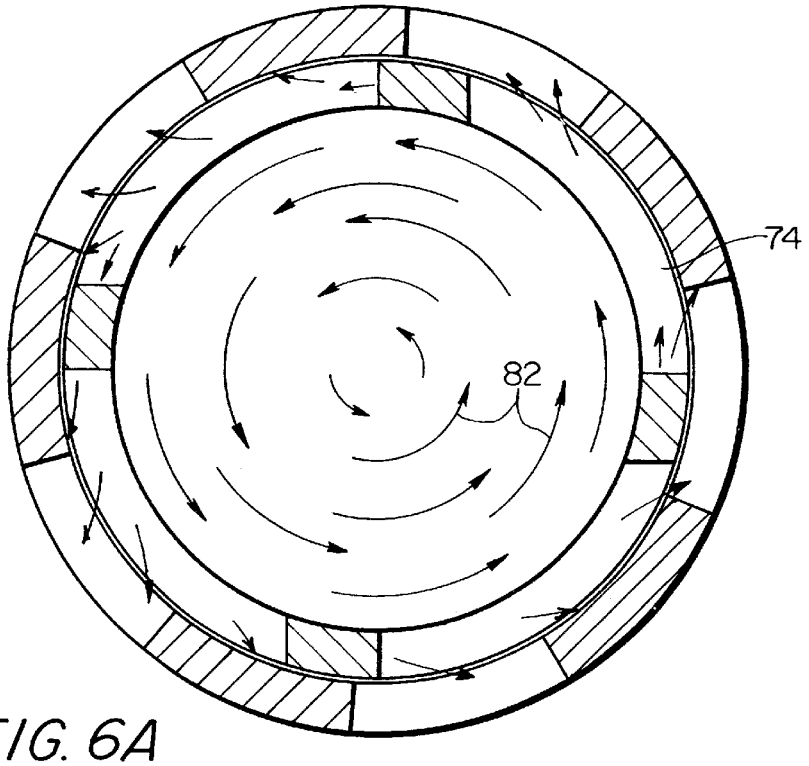
FIG. 6A PRIOR ART
FIG. 6A is an end view of the prior art schematically showing undesirable swirling action that may result in conglomeration of particulates and/or reduced throughout volume.
Figure 6B:
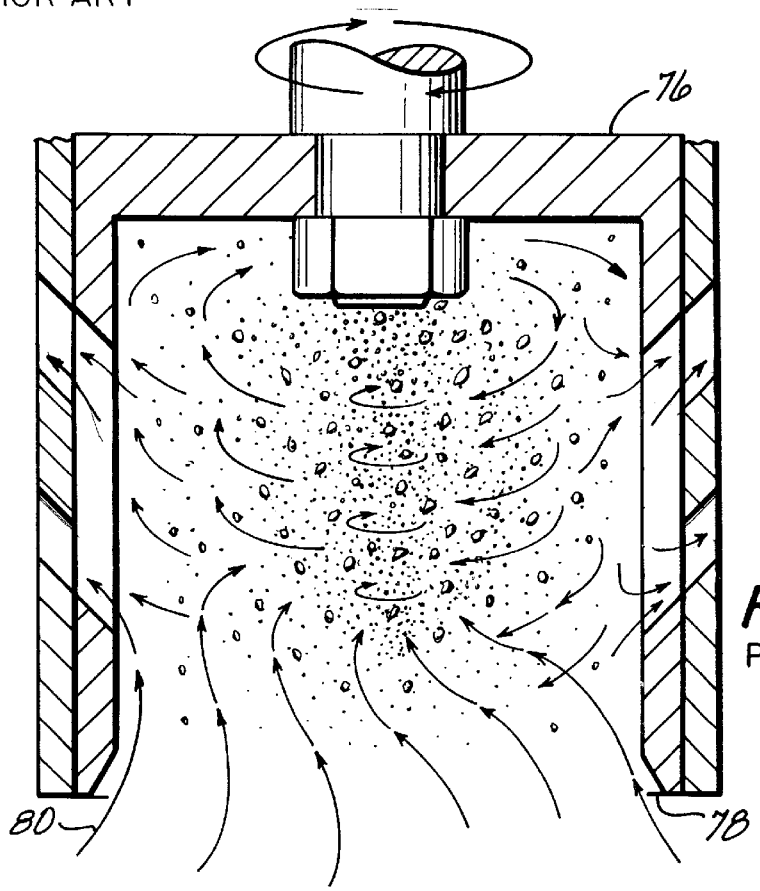
FIG. 6B PRIOR ART
FIG. 6B is a side view of the prior art showing the same undesirable swirling action as shown in FIG. 6A.

FIGS. 6A and 6B are representative of the problems with conventional rotor type apparatus for mixing, grinding, dispersing or emulsifying. As schematically represented in FIGS. 6A and 6B, cylindrical rotors such as rotor 74 having a closed end 76 and an open inlet end 78 are designed to draw liquid upwardly upon rotation. Centrifugal force within the rotor body 74 creates a swirling action as represented by arrows 82. It is this swirling action that causes a vacuum induced lift of material into rotor body 74. With a significant amount of lift, and a mixture of liquid and solid particulate product, too much particulate product may be drawn into rotor body to be adequately dispersed, ground, emulsified or otherwise processed. Thus, the excess mass of particulate product continues to swirl at the center of rotor 74 and may conglomerate to form a more solid mass that may not be effectively processed. This problem is exacerbated by deeper or more elongate rotors that develop more lift or higher rotor speeds that have the same effect. This condition develops into a significant problem with respect to size reduction and liquification of polymers such as elastomers processed with a solvent, for example, and used in the formation of adhesive cement. When such elastomers are sheared in a rotor/stator device of the prior art, such as the one disclosed in the '617 patent, heat is developed by the friction between colliding particulates of elastomer and the elastomer becomes soft and tacky. The particulates therefore tend to stick together and form a mass of elastomer 84 within the rotor body. This mass 84 may continue to grow and eventually plug rotor body 74. This will prevent continued grinding, emulsifying or other processing of the elastomer product.

Figure 7:
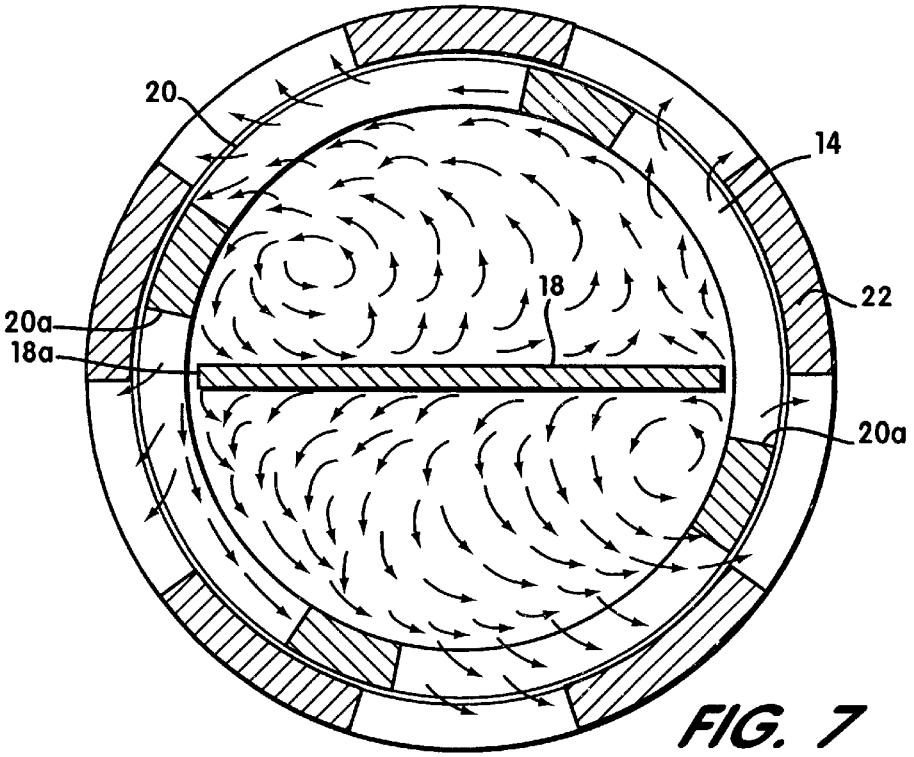
FIG. 7 is an end view of an apparatus in accordance with the present invention and schematically showing desirable flow characteristics attributed of the invention.
Figure 8:
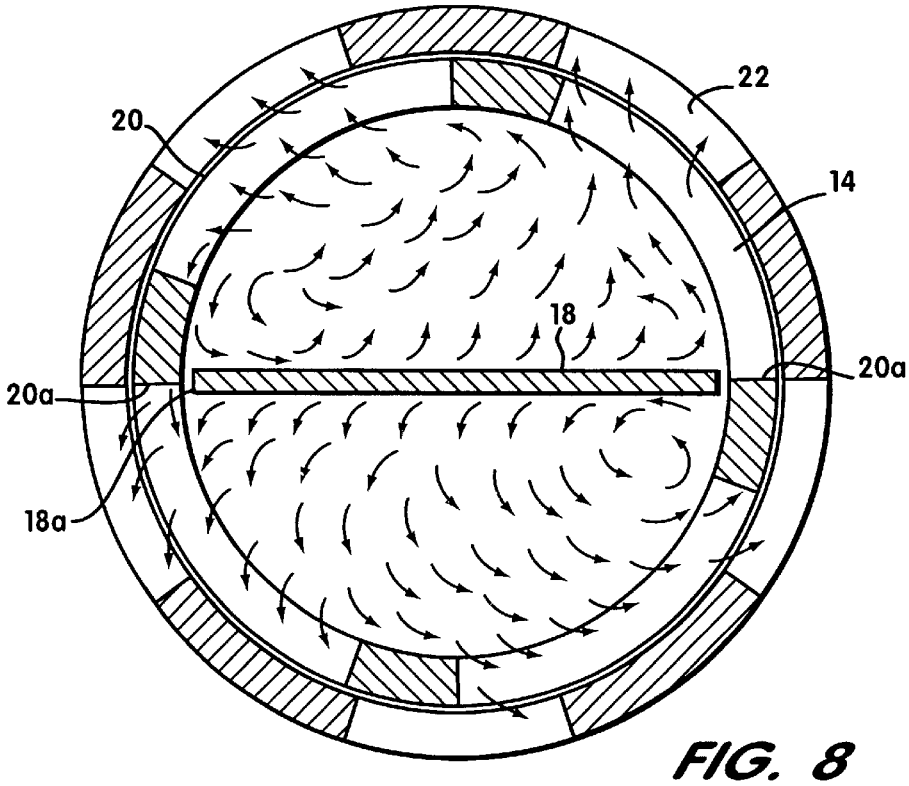
FIG. 8 is an end view of an apparatus constructed in accordance with the invention and similar to FIG. 7 but showing the rotor body further rotated with respect to the flow divider plate.

As depicted in FIGS. 7 and 8, the present invention eliminates the undesirable spiraling of particulate product within the rotor body 14 and promotes a desirable flow pattern within the rotor body 14. The liquid and solid particulates travel into the rotor body 14 on both sides of the flow divider plate 18 and move generally in the direction of rotation of the rotor body 14. Some particulate product exits the rotor body 14 through the slots 20 while other particulate product will be compressed or sheared against the side edges 18*a*, 18*b* of the flow divider plate 18. As the liquid and particulates reach the side edges 18*a*, 18*b* of the flow divider plate 18, a vacuum effect is developed as the gap between a rotor slot edge 20*a* and a side 18*a* or 18*b* of the flow divider plate 18 closes. This action draws liquid and particulate product into the next rotor slot 20. As the edge 20*a* of the slot 20 passes the flow divider plate 18, the gap between them is closed forcing particulate product into the stator slot 22 after it has been sheared and reduced in size. The flow divider plate 18 therefore helps force the particulate product into slots 20 in the rotor and subsequently into the stator slots 22 of immediate size reduction. This eliminates the frictionally heating of particulates caused, for example, by the particulates continually colliding with each other and contacting the stator slots 22 but not extending or traveling far enough into the stator slots 22 to be sheared and reduced in size.

Figure 9:
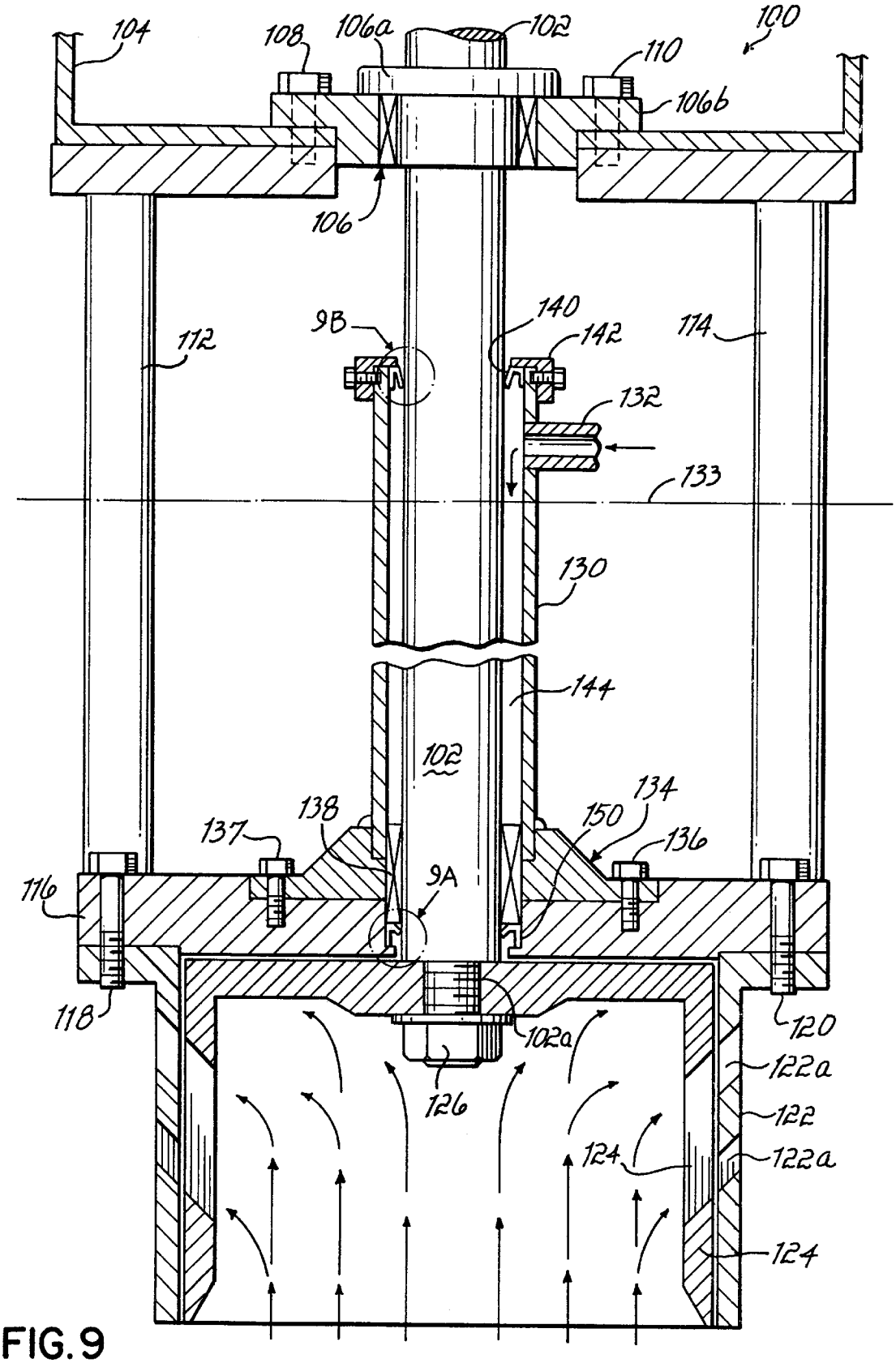
FIG. 9 is a cross sectional view of an alternative embodiment of the apparatus having a liquid flushing and coolant system.

FIG. 9 illustrates an alternative apparatus 100 constructed in accordance with the invention. Apparatus 100 includes a rotatable shaft 102 as in the previous embodiment and may also include a protective housing 104. Shaft 102 is rotated by a conventional electric motor (not shown). An alignment bearing 106 supports a portion of shaft 102 for rotation and is secured to housing 104 by fasteners 108, 110. Bearing 106 includes a rotating portion 106*a* and a stationary portion 106*b*. A plurality of support rods 112, 114 extend generally between housing 104 and a flange 116. Fasteners 118, 120 secure flange 116 to a stator 122 having openings 122*a* and, for example, described with respect to previous embodiments. An internal rotor 124 having openings 124*a* is connected to shaft 102 by a nut 126 secured to a threaded shaft portion 102*a*.

In accordance with this aspect of the invention, and also shown in FIG. 9, a tube 130 surrounds a portion of shaft 102. This tube 130 includes an inlet 132 for receiving a lubricant, such as water, solvent, oil or, for example, another component of the product being processed. Preferably, inlet 132 is disposed above the upper level 133 of this product. Tube 130 is secured to flange 116 by an adaptor or mounting assembly 134 and fasteners 136, 137. A bushing, which may be formed of brass, Teflon or other material, is retained generally between rotatable shaft 102 and flange 116, mounting assembly 134 and tube 130. A lip seal 140 is disposed at an upper end of tube 130 and may be retained in place by a seal mounting assembly 142 as shown. Lip seal 140 may instead comprise another type of seal, such as a mechanical seal or packing seal. Another lip seal 150, oriented in an opposite manner, is retained at a lower end of shaft 102. Lip seal 140 is mounted in a conventional fashion to retain liquid within a space 144 formed between tube 130 and shaft 102. However, lip seal 150 is oriented unconventionally, in an opposite manner, to allow a small steady stream of liquid past seal 150. As discussed below, this washes away any abrasive particles that would wear down the lip 150. Such wear would then allow an excessive amount of liquid into the product. Lip seal 150 may comprise another form of seal in accordance with this aspect of the invention as long as the washing effect is provided by the substituted seal.

Figure 9A:
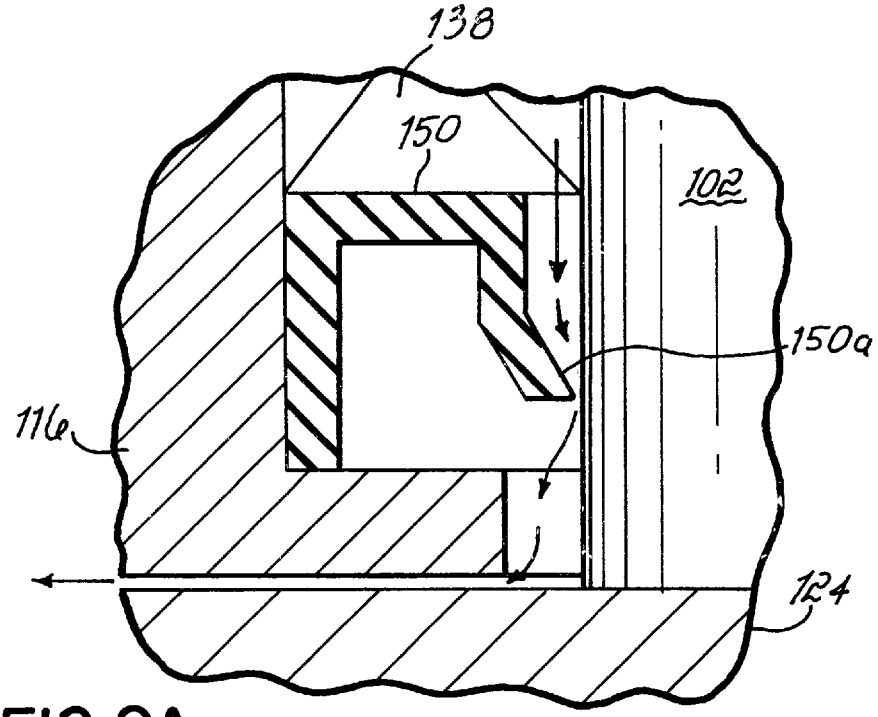
FIG. 9A is an enlarged view of encircled portion 9A of FIG. 9.
Figure 9B:
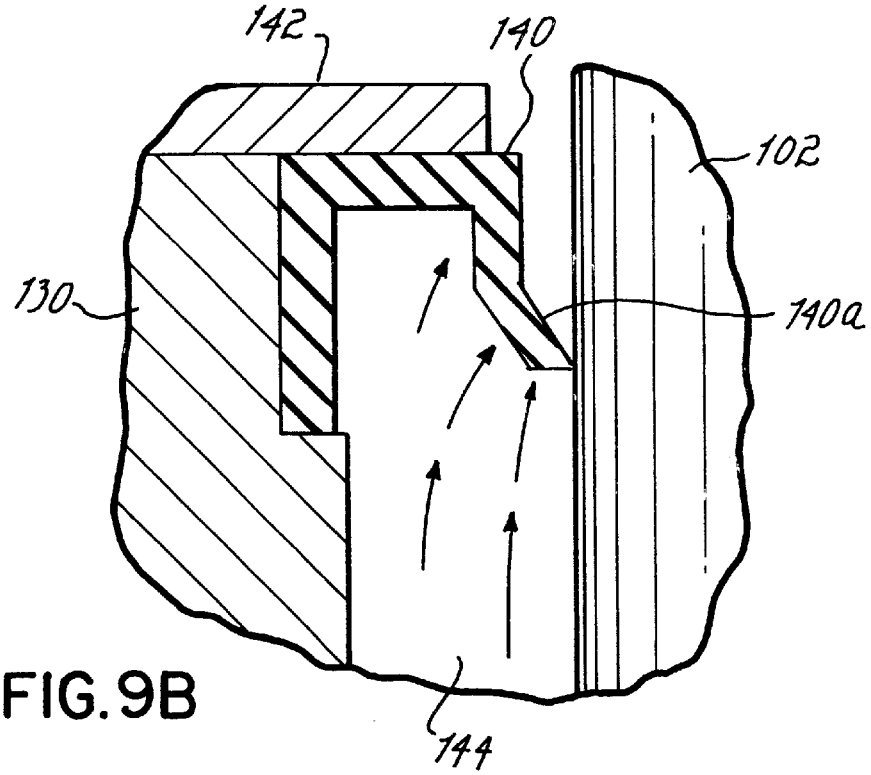
FIG. 9B is an enlarged view of encircled portion 9B of FIG. 9.

As better shown in FIG. 9A, lip seal 150 includes an edge portion 150*a* that would normally bear against rotatable shaft 102. When oriented in a reversed manner according to the invention, however, tip portion 150*a* is forced in a radially outward direction by hydraulic pressure within space 144. This allows a steady leakage of liquid past edge portion 150*a* in the direction of the arrows. This liquid carries any abrasives past seal 150 and into the product being processed by apparatus 100. Thus, the abrasives do not remain between lip seal 150 and rotating shaft 102 to gradually wear away lip seal 150. On the other hand, as shown in FIG. 9B, lip seal 140 operates in a reverse manner to retain liquid in a pressurized condition within space 144. In this regard, hydraulic pressure within space 144 bears against the interior of lip seal 140 and forces edge portion 140*a* against rotating shaft 102 with line contact. Importantly, lip seal 140 seals the opposite end of tube 130 with respect to seal 150 so that liquid pressure can develop and force the lubricating liquid past the bottom lip seal 150. Standard dimensions for lip seals 144, 150 with respect to shaft 102 may be used in the invention. Also, a pressure gauge may be connected to inlet 132 and, when the pressure of the lubricant in tube 130 drops, this would indicate the need to replace seal 150.

While preferred embodiments of this invention have been described in detail above, those of ordinary skill in the art will readily recognize many modifications and substitutions still falling within the spirit and scope of the invention. Therefore, applicant does not intend to be bound by the details provided herein but only by the appended claims.

What is claimed is:

1. An apparatus for mixing, grinding, dispersing or emulsifying comprising:

a rotatable drive;

a rotor body operatively connected for rotation with the rotatable drive, the rotor body including a hollow interior and at least one aperture for allowing fluid flow therethrough;

flow divider plate structure extending within the hollow interior of the rotor body for preventing conglomeration of particulates contained within fluid in the rotor body;

wherein the rotor body is a generally cylindrical body with an open end and the flow divider plate structure extends through the open end.

2. An apparatus for mixing, grinding, dispersing or emulsifying comprising:

support structure including a stationary stator body;

a rotatable drive;

a rotor body operatively connected for rotation with the rotatable drive and disposed at least partially within the stator body, the stator and rotor bodies including apertures for allowing fluid flow therethrough; and flow divider plate structure attached to the support structure and extending within the rotor body for preventing conglomeration of particulates contained within fluid in the rotor body.

3. The apparatus of claim 2 wherein the flow divider plate structure is stationary relative to the rotor body.

4. The apparatus of claim 3 wherein the flow divider plate structure is located centrally within the rotor body.

5. The apparatus of claim 4 wherein the rotor body includes an axis of rotation and the flow divider plate structure extends along the axis of rotation and diametrically across the rotor body.

6. The apparatus of claim 3 wherein the flow divider plate structure is affixed to the stator body.

7. The apparatus of claim 2 wherein the stator body and rotor body are cylindrically shaped.

8. The apparatus of claim 7 wherein the flow divider plate structure extends more than halfway into the rotor body.

9. The apparatus of claim 8 wherein the rotor body includes a substantially closed end and an open end and the flow divider plate structure extends into the rotor body from the open end.

10. The apparatus of claim 7 wherein the drive further includes a drive shaft affixed to the rotor body and the apparatus further includes a centering pin connected between the drive shaft and the flow divider plate structure.

11. The apparatus of claim 10 wherein the drive shaft includes a center bushing and the centering pin is rigidly affixed to the flow divider plate structure and disposed within the center bushing.

12. The apparatus of claim 2 wherein the apertures in the rotor and stator bodies have shearing edges that cooperate to shear particulates contained in liquid conveyed therebetween.

13. A method of grinding, mixing, dispersing or emulsifying a liquid containing solid particulates, the method comprising the steps of:

conveying a mixture of liquid and solid particulates into a rotating, generally cylindrical rotor body;

interrupting a resulting swirling flow of the mixture with plate structure extending within the rotor body thereby preventing conglomeration of particulates within the mixture; and conveying the mixture through holes in the rotor body and through adjacent holes in a stator body that receives the rotor body.

14. A method of grinding, mixing, dispersing or emulsifying a liquid containing solid particulates, the method comprising the steps of:

conveying a mixture of liquid and solid particulates into a rotating, generally cylindrical rotor body;

interrupting a resulting swirling flow of the mixture with plate structure extending within the rotor body thereby preventing conglomeration of particulates within the mixture; and shearing the particulates as they pass through holes in the rotor and stator bodies.

15. A method as recited in claim 13 wherein the plate structure is stationary.

* * * * *